US005325969A

United States Patent [19]

Gordon et al.

[11] Patent Number: 5,325,969

[45] Date of Patent: Jul. 5, 1994

[54] LUNCH PAIL HAVING DETACHABLE FOOD COMPARTMENT

[76] Inventors: Delbert L. Gordon, 233 Laurel St., Lake Jackson, Tex. 77566; Troy L. Smith, P.O. Box 1818, Brazoria, Tex. 77422

[21] Appl. No.: 18,353

[22] Filed: Feb. 17, 1993

[51] Int. Cl.[5] ..... H45C 11/20

[52] U.S. Cl. ..... 206/546; 206/541; 206/549

[58] Field of Search ..... 206/546, 549, 541, 545

[56] References Cited

U.S. PATENT DOCUMENTS

| | | | |
|---|---|---|---|
| 450,988 | 4/1891 | Brown | 206/542 |
| 1,015,455 | 1/1912 | Neesham | 206/546 |
| 1,677,276 | 7/1928 | Deicker | 206/545 |
| 2,731,996 | 1/1956 | Hayes | 206/546 X |
| 3,372,690 | 3/1968 | Ruiz | 206/546 X |
| 4,078,701 | 3/1978 | Clubb | 206/546 X |
| 4,648,512 | 3/1987 | Tarozzi et al. | 206/545 X |
| 4,899,904 | 2/1990 | Dooley et al. | 206/545 X |

*Primary Examiner*—William I. Price
*Attorney, Agent, or Firm*—Kenneth A. Roddy

[57] ABSTRACT

A lunch pail assembly has an upper member having a bottom wall, opposed side walls and end walls defining a first food and beverage compartment, a lid at the upper end of the first food and beverage compartment, a handle on the lid, and a fastening mechanism on the exterior of the opposed end walls. A detachable lower member having a bottom wall, opposed side walls and end walls defines a second food compartment having an open top end which is received within a depending lip on the bottom of the upper member. Catches on the end walls of the lower member releasably engage the fastening mechanisms on the upper member to selectively releasably connect the upper and lower members together to be carried as a single unit wherein food, beverages, and other articles of one type may be contained in the first food and beverage compartment and isolated from food and other articles of another type contained in the second food compartment. The upper member can be used independently of the lower member when disconnected therefrom. The lower member may be used to carry frozen dinners or may be used as a plate. A dish-shaped plate insert and cover fit inside the detachable lower member and are microwave, freezer, and dishwasher safe, whereby meals, such as a plate lunch, can be prepared in advance, placed in plate inserts, stored in a refrigerator or freezer, transported in the lower member, and when desired, placed in a microwave oven for preparing the food contained therein.

7 Claims, 2 Drawing Sheets

LUNCH PAIL HAVING DETACHABLE FOOD COMPARTMENT

BACKGROUND OF THE INVENTION

1. Field of the Invention

This invention relates generally to lunch pails, and more particularly to a lunch pail having a separate, detachable compartment for carrying plate lunches and other articles.

2. Brief Description of the Prior Art

In the work world of today, we have come a long way from carrying our lunch in a brown paper bag. More sophisticated means of carrying lunches are introduced on the market each year. One of the major problems with current lunch palls in general is: most commercially available lunch pails have only a single carrying compartment with perhaps one small tray insert. Many people would prefer to carry a plate lunch, be it homemade or store bought, due to the availability of microwave ovens in work places. Most lunch pails of today are not designed to carry a plate lunch, but rather sandwiches, fruit, and maybe a few small containers.

Therefore, I have designed a lunch pail with a detachable compartment which can be used as a plate and to carry plate lunches while still maintaining the main lunch pail compartment for snacks, fruit, drinks, and other desired articles.

There are several patents which disclose lunch pails and connectable containers.

Ruiz, U.S. Pat. No. 3,372,690 discloses an insulated lunch box having an insulated base portion with an upper tray-supporting surface with side panels hingedly connected at their bottom ends to the base portion to define a single compartment. Each of the side panels pivot to a vertical position and are provided with a groove on their inner surface which is positioned parallel to the upper tray-supporting surface of the base portion. A food tray having a peripheral horizontal flange is removably received on the tray-supporting surface of the base portion with its horizontal flange resting on the vertical flange of the base portion. The food tray is covered by a cover having outer edges which are folded over the horizontal flange of the food tray. The outer periphery of horizontal flange of the food tray and cover is received in the grooves of the side portions when they are vertically disposed.

Clubb, U.S. Pat. No. 4,078,701 discloses a multi-vessel container unit wherein either vessel is used to carry ice and/or liquids. The Clubb device has separate vessels removably mounted one on top of the other and held together by hinged clamps. The upper vessel is uninsulated and has a vertical pouring spout of sufficient diameter to receive and pass ice cubes therethrough and the lower vessel is insulated and has an open top end to receive ice cubes and a pouring spout on the side of sufficient diameter to prevent the passage of ice cubes therethrough. The bottom of the upper vessel is received in the open top end of the lower vessel. An insulating cover may be placed in the lower vessel a short distance below the open top end to prevent heat exchange between the two vessels.

The present invention is distinguished over the prior art in general, and these patents in particular by a lunch pail assembly having an upper member with a first food or beverage compartment for containing one type of food such as sandwiches or beverages and a detachable lower member having a second food compartment for containing another type of food such as a plate lunch. The upper member has a bottom wall, opposed side walls and end walls defining the first food and beverage compartment, a lid at the upper end of the first food and beverage compartment, a handle on the lid, and a fastening mechanism on the exterior of the opposed end walls. The lower member has a bottom wall, opposed side walls and end walls defining the second food compartment which has an open top end that is received within a depending lip on the bottom of the upper member. Catches on the end walls of the lower member releasably engage the fastening mechanisms on the upper member to selectively releasably connect the upper and lower members together to be carried as a single unit wherein food, beverages, and other articles of one type may be contained in the first food and beverage compartment and isolated from food and other articles of another type contained in the second food compartment. The upper member can be used independently of the lower member when disconnected therefrom. The lower member may be used to carry frozen dinners or may be used as a plate. A dish-shaped plate insert and cover fit inside the detachable lower member and are microwave, freezer, and dishwasher safe, whereby meals, such as a plate lunch, can be prepared in advance, placed in plate inserts, stored in a refrigerator or freezer, transported in the lower member, and when desired, placed in a microwave oven for preparing the food contained therein.

SUMMARY OF THE INVENTION

It is therefore an object of the present invention to provide a lunch pail having an upper member with a first food or beverage compartment for containing one type of food such as sandwiches or beverages and a detachable lower member having a second food compartment for containing another type of food such as a plate lunch.

It is another object of this invention to provide a lunch pail having an upper member with a first food or beverage compartment and a detachable lower member having a second food compartment which may be disconnected from the upper member and stored in a refrigerator or freezer until needed.

Another object of this invention is to provide a lunch pail having an upper member with a first food or beverage compartment and a detachable lower member having a second food compartment which may be disconnected from the upper member and placed in a microwave oven for heating or preparing the food contained therein.

Another object of this invention is to provide a lunch pail having an upper member with a first food or beverage compartment and a detachable lower member having a second food compartment which may be easily connected to the upper member and, when connected, the assembly being conveniently carried as a single unit.

A further object of this invention is to provide a lunch pail having an upper member with a first food or beverage compartment and a detachable lower member having a second food compartment which may be used as a storage compartment for containing commercially available frozen dinners or may be used as a plate.

A still further object of this invention is to provide a lunch pail having an upper member with a first food or beverage compartment, a detachable lower member having a second food compartment, and one or more dish-shaped plate inserts and covers therefor which fit inside the detachable lower member and are microwave, freezer, and dishwasher safe, whereby several meals may be prepared in advance and placed in individual plate inserts, stored in a refrigerator or freezer, transported in the detachable lower member, and when desired, placed in a microwave oven for preparing the food contained therein.

Other objects of the invention will become apparent from time to time throughout the specification and claims as hereinafter related.

The above noted objects and other objects of the invention are accomplished by a lunch pail assembly having an upper member with a first food or beverage compartment for containing one type of food such as sandwiches or beverages and a detachable lower member having a second food compartment for containing another type of food such as a plate lunch. The upper member has a bottom wall, opposed side walls and end walls defining the first food and beverage compartment, a lid at the upper end of the first food and beverage compartment, a handle on the lid, and a fastening mechanism on the exterior of the opposed end walls. The lower member has a bottom wall, opposed side walls and end walls defining the second food compartment which has an open top end that is received within a depending lip on the bottom of the upper member. Catches on the end walls of the lower member releasably engage the fastening mechanisms on the upper member to selectively releasably connect the upper and lower members together to be carried as a single unit wherein food, beverages, and other articles of one type may be contained in the first food and beverage compartment and isolated from food and other articles of another type contained in the second food compartment. The upper member can be used independently of the lower member when disconnected therefrom. The lower member may be used to carry frozen dinners or may be used as a plate. A dish-shaped plate insert and cover fit inside the detachable lower member and are microwave, freezer, and dishwasher safe, whereby meals, such as a plate lunch, can be prepared in advance, placed in plate inserts, stored in a refrigerator or freezer, transported in the lower member, and when desired, placed in a microwave oven for preparing the food contained therein.

DESCRIPTION OF THE PREFERRED EMBODIMENT

Figure 1:
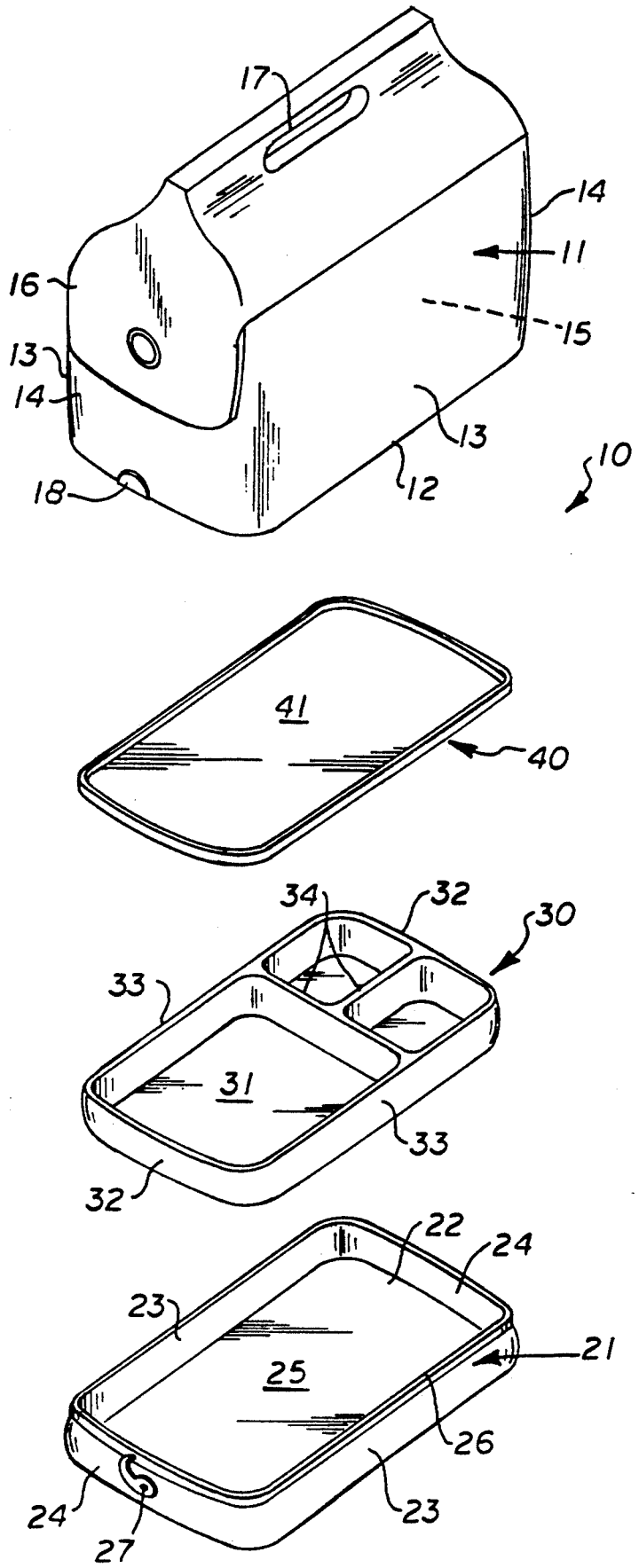
FIG. 1 is an exploded isometric view of a preferred lunch pail assembly in accordance with the present invention, shown with the upper member, the detachable lower member, a plate insert, and cover member in an unassembled condition.
Figure 2:
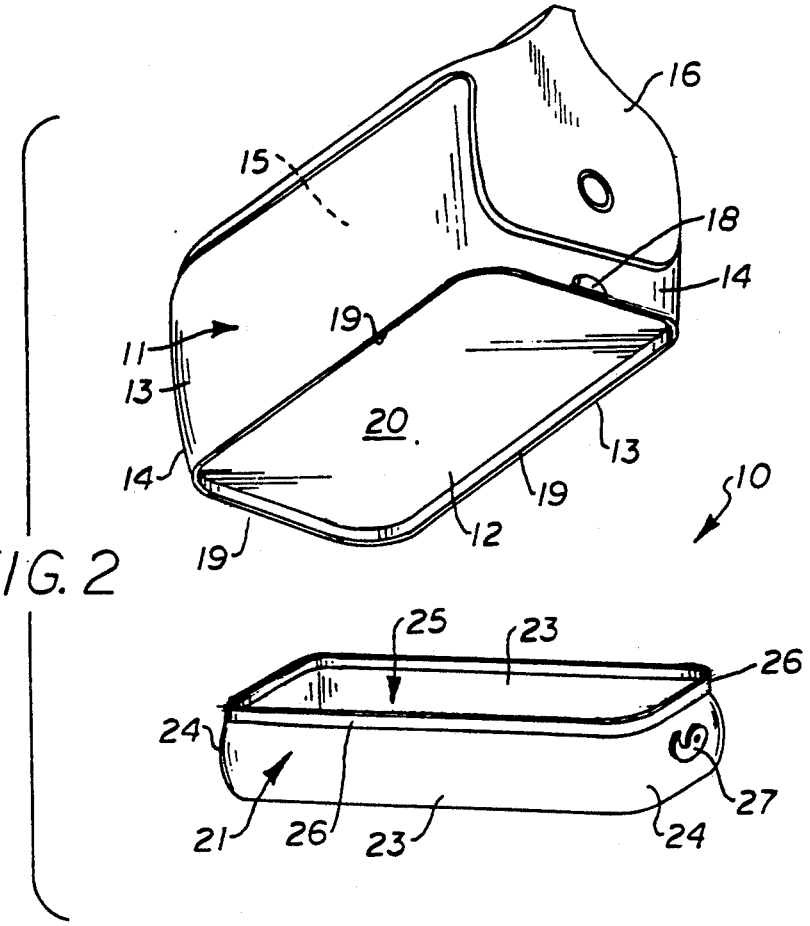
FIG. 2 is an exploded perspective view of the lunch pail assembly, shown with the detachable lower member disconnected from the bottom of the upper member.

Referring to the drawings by numerals of reference, there is shown in FIGS. 1 and 2, a lunch pail assembly 10 in accordance with the present invention which has a main or first food and beverage compartment and a detachable secondary or second food compartment for selectively carrying different types of lunches and other articles. The lunch pail assembly 10 includes an upper member 11 preferably formed of plastic having a bottom wall 12, opposed side walls 13 and end walls 14 extending upwardly from the bottom wall defining a first food and beverage compartment 15, an open and closable lid 16 at an upper end of the side walls and end walls defining a closure for the first food and beverage compartment, a handle 17 on the lid, and a boss or catch 18 protruding from the exterior of the opposed end walls 14 near their bottom edge. As best seen in FIG. 2, the opposed side walls 13 and end walls 14 of the upper member 11 extend a short distance beneath the bottom wall 12 to define a depending lip 19 surrounding a central recessed area 20.

Figure 3:
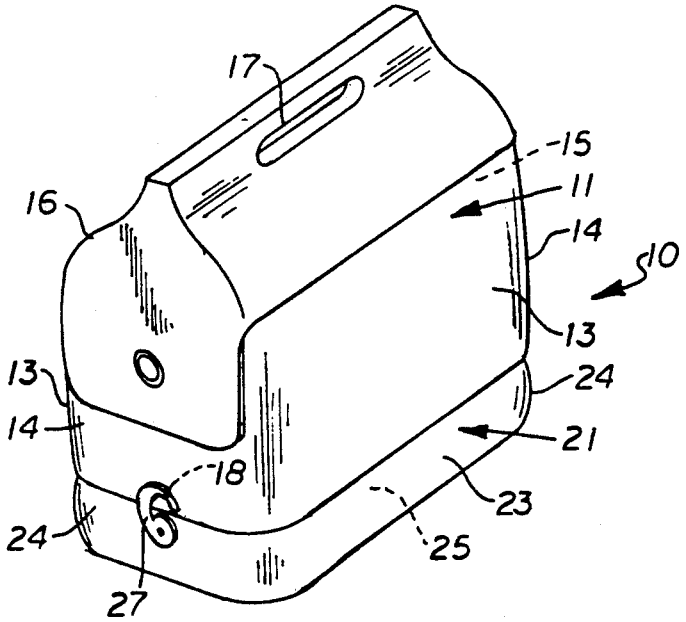
FIG. 3 is an isometric view of the lunch pail assembly in the assembled condition with the detachable lower member secured to the bottom of the upper member.

The lunch pail assembly 10 includes a lower member 21, preferably formed of plastic, having a bottom wall 22, opposed side walls 23 and end walls 24 extending upwardly from the bottom wall to define a secondary or second food compartment 25 having an open top end. The open top end of the lower member 21 has a reduced periphery forming an inset lip 26 sized to be slidably received within the depending lip 19 of the upper member 11 and engaged on the recessed area 20 (FIG. 2). The lower member 21 has a fastener 27 rotatably attached to each end wall 24 adjacent the open top end which, when rotated, will engage the catches 18 on the upper member 11 to securely connect the upper and lower members 11 and 21 together for carrying convenience, as shown in FIG. 3.

The lower member 21 is selectively releasably connected to the bottom of the upper member 11 and, when connected, the upper and lower members 11 and 21 (FIG. 3) are conveniently carried as a single unit whereby food, beverages, and other articles of one type may be contained in the first food and beverage compartment 15 and isolated from food and other articles of another type contained in the second food compartment 25. The upper member 11 can be used alone independently of the lower member 21 when disconnected therefrom for containing food, beverages, and other articles, in the manner of a conventional lunch pail.

Referring again to FIG. 1, the lunch pail assembly 10 may also include one or more dish-shaped plate inserts 30 having a bottom wall 31 and opposed end walls 32 and side walls 33 extending upwardly therefrom. The plate insert 30 is sized and shaped to be removably received within the second food compartment 25 of the lower member 21. The preferred dish-shaped plate insert 30 has a plurality of upstanding walls 34 dividing it into separate sections for containing different food products whereby a plate lunch type of meal may be contained therein. A cover member 40 is also provided for each plate insert 30 which is sized and shaped to be removably engaged on the upper ends of the plate insert walls and form an air tight seal thereon. The top surface 41 of each cover member 40 is sized and shaped to receive and support the bottom wall 31 of another dish-shaped plate insert 30 such that a plurality of assembled plate inserts and cover members may be conveniently stacked and stored one on top of the other in a refrigerator or freezer. The plate inserts 30 and cover members 40 are preferably formed of a durable plastic material that is microwave, freezer and dishwasher safe. Several plate inserts and covers may be purchased as accessories for the convenience of preparing and storing several meals in advance.

As mentioned above, the upper member 11 can be used alone without the lower member 21 connected in the manner of a conventional lunch pail if a plate lunch is not desired. The lower member 21 can also be connected to the upper member 11 and used without the plate insert 30 and cover 40. For example, a store bought frozen dinner may be carried in the lower member 21 and the upper member 11 may be used to carry beverages or other items. The lower member 21 may also be used as a plate when disconnected from the upper member 11. Also, a regular lunch may be carried in the upper member 11 and the lower member 21 may be used for carrying articles other than food, such as pens, pencils, calculators, rulers, and so on.

The plate inserts 30 are particularly suited for allowing plate lunches to be carried in the lower member 21. This makes it possible to prepare several meals in advance (by using a microwave oven or other means) and place them in individual plate inserts and store them in a refrigerator freezer until needed. The plate inserts 30 can then be carried to the work place in the second food compartment 25 of the lower member 21 which is connected to the bottom of the upper member 11. The plate insert 30 can then be removed and placed in a refrigerator or freezer at the work place and then at lunch time, the plate insert can be placed in a microwave oven to heat the meal contained therein.

While this invention has been described fully and completely with special emphasis upon a preferred embodiment, it should be understood that within the scope of the appended claims the invention may be practiced otherwise than as specifically described herein.

We claim:

1. A lunch pail having a first food and beverage compartment and a detachable second food compartment for selectively carrying different types of lunches and other articles comprising:

an upper member having a bottom wall, opposed side walls and end walls extending upwardly therefrom defining a first food and beverage compartment, an open and closable lid at an upper end of said side walls and end walls defining a closure for said first food and beverage compartment, a handle on said lid, and one element of a fastening mechanism on the exterior of said opposed end walls disposed adjacent said bottom wall;

said upper member opposed side walls and end walls extending a short distance beneath said bottom wall to define a depending lip surrounding a central recessed area; and a lower member having a bottom wall, opposed side walls and end walls extending upwardly therefrom defining a second food compartment having an open top end sized to be slidably received within said upper member depending lip and engaged on said recessed area, and a mating element of said fastening mechanism on the exterior of each said end wall adjacent said open top end that will releasably engage said fastening mechanisms on said upper member end walls;

said lower member being selectively releasably connected to the bottom of said upper member and said connected upper and lower members conveniently carried as a single unit whereby food, beverages, and other articles of one type may be contained in said first food and beverage compartment and isolated from food and other articles of another type contained in said second food compartment; and said upper member being selectively capable of use independently of said lower member when disconnected therefrom for containing food, beverages, and other articles.

2. The lunch pail according to claim 1 further comprising;

a dish shaped plate insert having a bottom wall and opposed end walls and side walls extending upwardly therefrom sized and shaped to be removably received within said lower member second food compartment; and a cover member sized and shaped to be removably engaged on the upper ends of said plate insert walls and form an air tight seal thereon, and having a top surface sized and shaped to receive and support the bottom wall of another said dish shaped plate insert such that a plurality of assembled said plate inserts and cover members may be stacked and stored one on top of the other; whereby several meals may be prepared in advance and placed in individual said plate inserts and stored in a refrigerator or freezer until needed.

3. The lunch pail according to claim 2 in which said dish shaped plate insert and said cover member are formed of microwaveable material to allow foods contained therein to be prepared in a microwave oven.

4. The lunch pail according to claim 2 in which said dish shaped plate insert has a plurality of upstanding walls dividing it into separate sections for containing different food products whereby a plate lunch type of balanced meal may be contained therein.

5. A lunch kit having a first food and beverage compartment and a detachable second food compartment for selectively carrying different types of lunches and other articles comprising in combination:

an upper member having a bottom wall, opposed side walls and end walls extending upwardly therefrom defining a first food and beverage compartment, an open and closable lid at an upper end of said side walls and end walls defining a closure for said first food and beverage compartment, a handle on said lid, and one element of a fastening mechanism on the exterior of said opposed end walls disposed adjacent said bottom wall;

said upper member opposed side walls and end walls extending a short distance beneath said bottom wall to define a depending lip surrounding a central recessed area; and a lower member having a bottom wall, opposed side walls and end walls extending upwardly therefrom defining a second food compartment having an open top end sized to be slidably received within said upper member depending lip and engaged on said recessed area, and a mating element of said fastening mechanism on the exterior of each said end wall adjacent said open top end that will releasably engage said fastening mechanisms on said upper member end walls;

a dish shaped plate insert having a bottom wall and opposed end walls and side walls extending upwardly therefrom sized and shaped to be removably received within said lower member second food compartment;

a cover member sized and shaped to be removably engaged on the upper ends of said plate insert walls and form an air tight seal thereon, and having a top surface sized and shaped to receive and support the bottom wall of another said dish shaped plate insert such that a plurality of assembled said plate inserts and cover members may be stacked and stored one on top of the other;

said lower member being selectively releasably connected to the bottom of said upper member and said connected upper and lower members conveniently carried as a single unit whereby food, beverages, and other articles of one type may be contained in said first food and beverage compartment and isolated from food and other articles of another type contained in said second food compartment;

said lower member being selectively capable of use for containing said plate insert and said cover member and independently of said plate insert and said cover member for containing food and other articles; and said upper member being selectively capable of use independently of said lower member when disconnected therefrom for containing food, beverages, and other articles.

6. The lunch kit according to claim 5 in which said dish shaped plate insert and said cover member are formed of microwaveable material to allow foods contained therein to be prepared in a microwave oven.

7. The lunch kit according to claim 5 in which said dish shaped plate insert has a plurality of upstanding walls dividing it into separate sections for containing different food products whereby a plate lunch type of balanced meal may be contained therein.

* * * * *